US005671823A

United States Patent [19]

Oakes

[11] Patent Number: 5,671,823

[45] Date of Patent: Sep. 30, 1997

[54] COLLAPSIBLE CATWALK

[76] Inventor: Keith L. Oakes, R. R. #2, Simcoe, Ontario, Canada, N3Y 4K1

[21] Appl. No.: 386,409

[22] Filed: Feb. 10, 1995

[51] Int. Cl.[6] ..... E04G 3/10

[52] U.S. Cl. ..... 182/36; 182/82; 182/113; 182/150

[58] Field of Search ..... 182/150, 113, 182/82, 36

[56] References Cited

U.S. PATENT DOCUMENTS

| | | | |
|---|---|---|---|
| 2,170,689 | 8/1939 | Loomis . | |
| 2,888,299 | 5/1959 | Balogh . | |
| 3,124,213 | 3/1964 | Jorsey | 182/150 X |
| 3,391,757 | 7/1968 | Duke et al. | 182/150 X |
| 3,900,080 | 8/1975 | Rea | 182/150 X |
| 3,907,066 | 9/1975 | Newton . | |
| 4,396,092 | 8/1983 | Thompson | 182/150 X |
| 4,440,262 | 4/1984 | Hunt et al. | 182/113 X |
| 4,482,284 | 11/1984 | Robbins et al. | 182/113 X |
| 4,546,973 | 10/1985 | Mouser . | |
| 4,570,749 | 2/1986 | McKibbin | 182/150 X |
| 4,679,657 | 7/1987 | Bennett et al. | 182/113 |
| 5,065,838 | 11/1991 | Finley | 182/150 X |
| 5,273,239 | 12/1993 | De Parny et al. | 182/150 X |

FOREIGN PATENT DOCUMENTS

| | | | |
|---|---|---|---|
| 848333 | 8/1970 | Canada | 182/150 |
| 0338145 | 10/1989 | European Pat. Off. | 182/150 |
| 1387059 | 12/1964 | France | 182/150 |
| 2283280 | 3/1976 | France | 182/150 |
| 52-13297 | 2/1977 | Japan | 182/150 |

*Primary Examiner*—Terry Lee Melius
*Assistant Examiner*—Christopher J. Novosad
*Attorney, Agent, or Firm*—Dale E. Schlosser; Arne I. Fors

[57] ABSTRACT

A collapsible catwalk comprising a support frame having a base and a top section, trolley members mounted on the frame top section adapted to suspend the support frame for lateral linear travel on at least one horizontal support rail, at least one guide wheel extending rearwardly from the support frame for maintaining the support frame vertical and for facilitating and guiding the support frame during lateral linear travel, a platform pivotally mounted on the support frame at the base thereof for pivotal movement from a substantially vertical retracted position to a substantially horizontal extended forward position, and collapsible safety rails surrounding the platform pivotally mounted on the platform for collapse upon retraction of the platform and for erection upon extension of the platform. The collapsible catwalk may additionally comprise a brake extending rearwardly from the platform for stopping the lateral movement of the catwalk when the platform is mentioned to its horizontal position.

10 Claims, 10 Drawing Sheets

COLLAPSIBLE CATWALK

FIELD OF INVENTION

This invention relates to a collapsible catwalk and, more particularly, relates to a mobile catwalk which may be pivoted and collapsed into an inoperative configuration and which may be moved laterally.

BACKGROUND OF THE INVENTION

Catwalks, scaffolds and similar platforms are utilized in various industries. Catwalks enable workers to have overhead access to structures at and below the position of the catwalk and enable workers to have access to the underside of elevated structures which are above the ground. Catwalks and scaffolds may be used to aid in the construction of buildings and are used to enable workers to have access to structures for maintenance or cleaning of the structures or to have access to assembly lines.

Catwalks and similar platforms are often permanent structures which extend outwardly from a fixed position or extend above or below a workpiece between two spaced apart positions. The worker has access to the workpiece at limited positions only. Several platforms may then be necessary to provide complete maintenance or construction of the workpiece.

Collapsible scaffolding systems such as that shown in U.S. Pat. No. 3,907,066 to Newton have been devised for use in the construction and maintenance of a building. The scaffolding system is lowered from the building and includes two wing sections to provide access to the building for workers. The lateral positioning of the scaffolding system may be changed by movement of cables which attach the scaffolding system to the building.

It is desirable to have ready access to worksites or workpieces at various locations above worksites or workpieces (or below as the case may be) for construction or maintenance thereof without the need for a multiplicity of platforms or complex scaffolding systems.

SUMMARY OF THE INVENTION

The disadvantages of the prior art may be substantially overcome by providing a mobile collapsible catwalk which may be vertically pivoted into a collapsed configuration for storage and/or which may be moved laterally to enable a worker to have access to a worksite or a workpiece at various locations along its In its broad aspect, the collapsible catwalk of this invention comprises a support frame having a base and a top section; trolley means mounted on the frame top section adapted to suspend the support frame for lateral linear travel on at least one horizontal support rail, at least one guide wheel extending rearwardly from the support frame for maintaining the support frame vertical and for facilitating and guiding the support frame during lateral linear travel, a platform pivotally mounted on the support frame at the base thereof for pivotal movement from a substantially vertical retracted position to a substantially horizontal extended forward position, collapsible safety rails surrounding the platform pivotally mounted on the platform for collapse upon retraction of the platform and for erection upon extension of the platform, and brake means operable by extension of the platform for stopping the lateral movement of the catwalk when the platform is extended to its horizontal position. The brake means preferably extend rearwardly from the platform, at the base thereof, for engagement with a horizontal beam.

In another embodiment, the collapsible catwalk may comprise a detent proximate the trolley means for stopping the lateral movement of the catwalk when the platform is extended to its horizontal position.

The said support frame comprises a pair of laterally equi-spaced vertical trusses having a narrow base and a relatively wide top section, and said trolley means comprise two sets of guide wheel trolleys mounted on the wide top section, one set mounted behind the other set and parallel thereto for suspension of the support frame on a pair of parallel support rails. A pair of spaced apart guide wheels preferably extend rearwardly from each side of the base for rolling engagement with a horizontal beam.

The pair of parallel support rails preferably comprise a pair of horizontal I-beams each having a lower flange. Each set of guide wheel trolleys has two pairs of opposed rollers journalled in a trolley homing for engaging the I-beam lower flange for travel thereon.

The catwalk support frame and platform may have a center of gravity offset from the vertical whereby the frame base is continuously biased by gravity rearwardly such that the pair of spaced apart guide wheels are kept in continuous rolling engagement with the horizontal beam.

BRIEF DESCRIPTION OF THE DRAWINGS

The present invention will now be described with reference to the accompanying drawings, in which.

DETAILED DESCRIPTION OF THE PREFERRED EMBODIMENT

Figure 1:
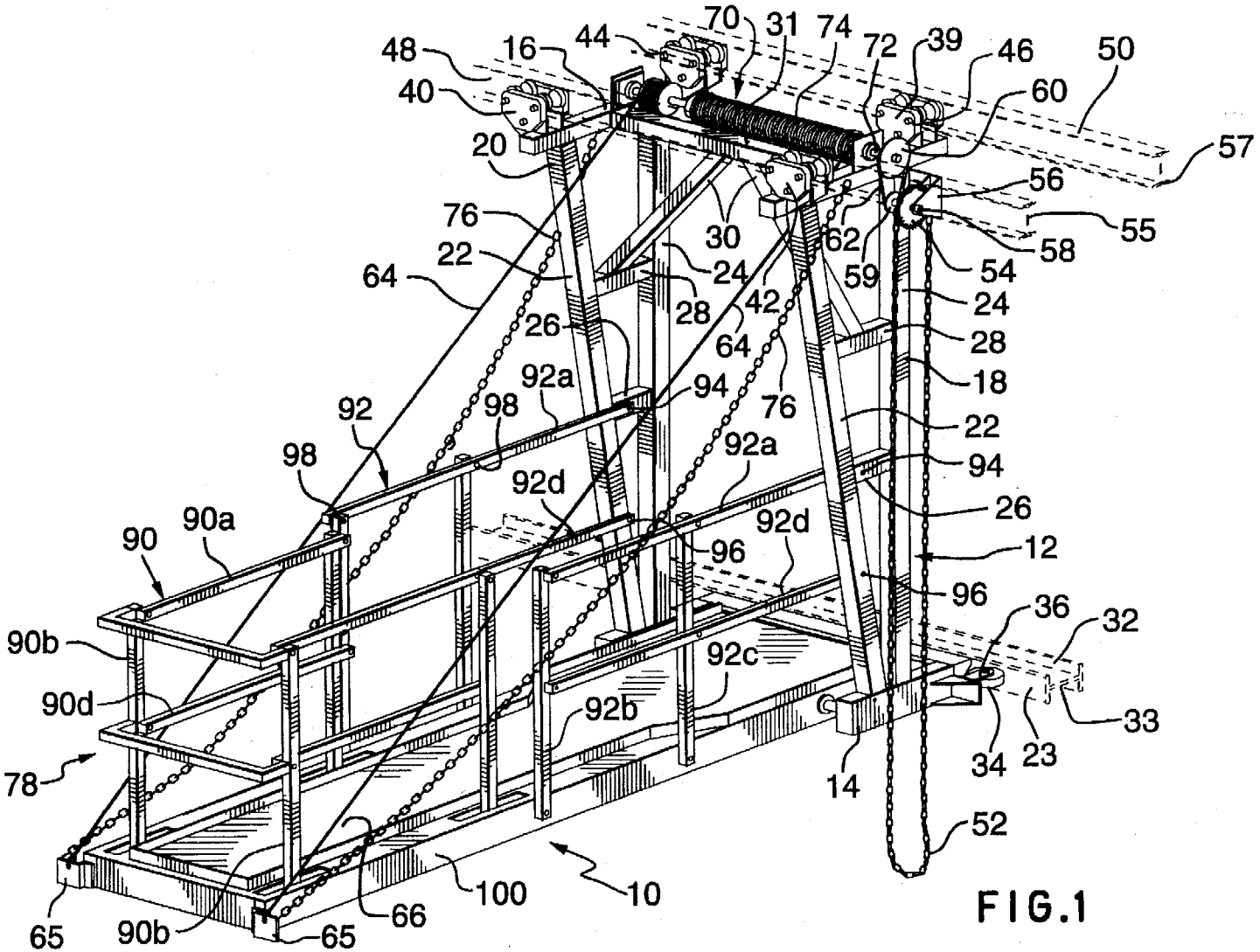
FIG. 1 is a perspective view of the collapsible catwalk in its open, fully extended, operative configuration in accordance with an embodiment of the present invention.
Figure 2:
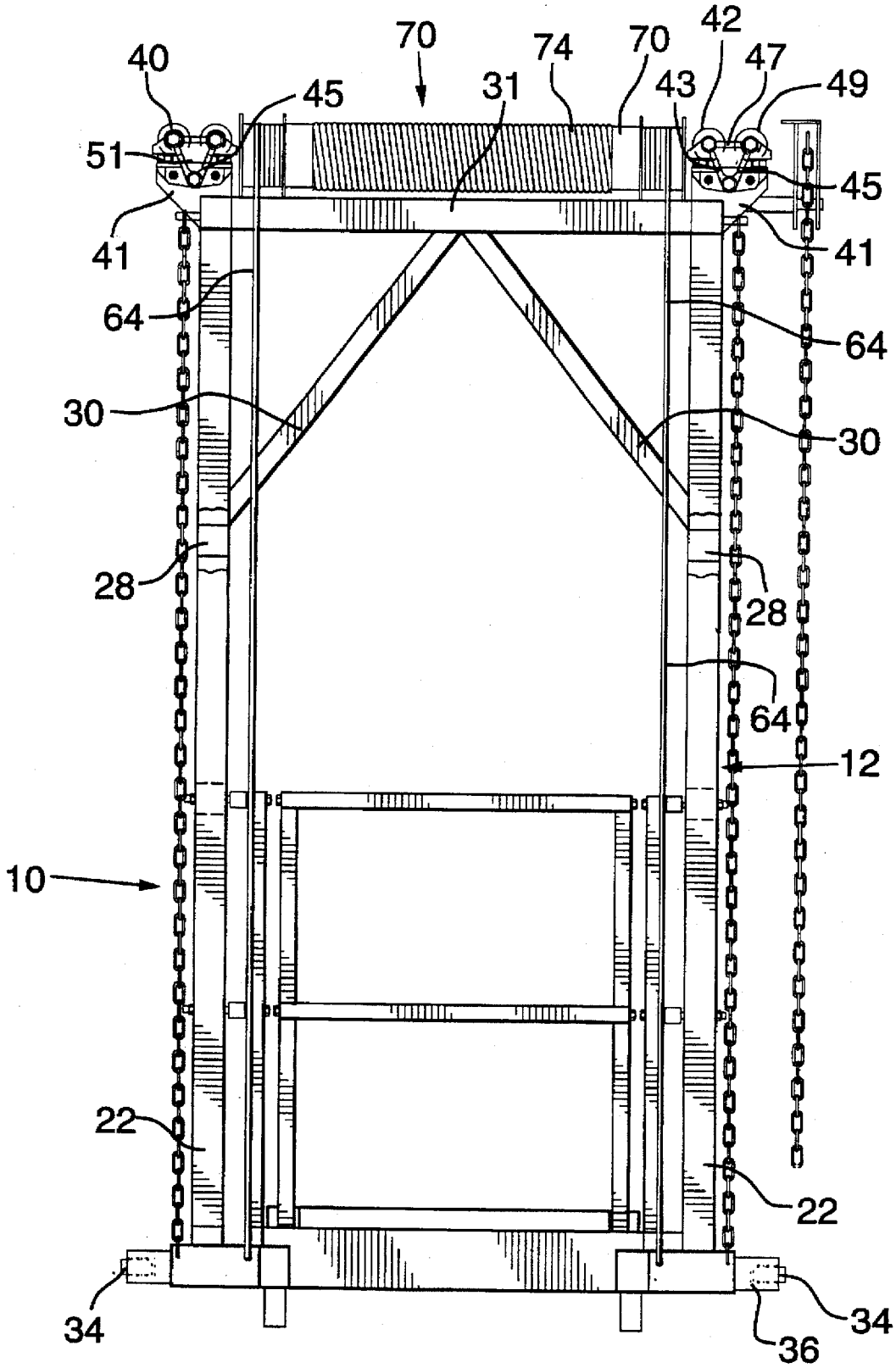
FIG. 2 is a front elevational view of the collapsible catwalk in the fully extended position shown in FIG. 1.
Figure 3:
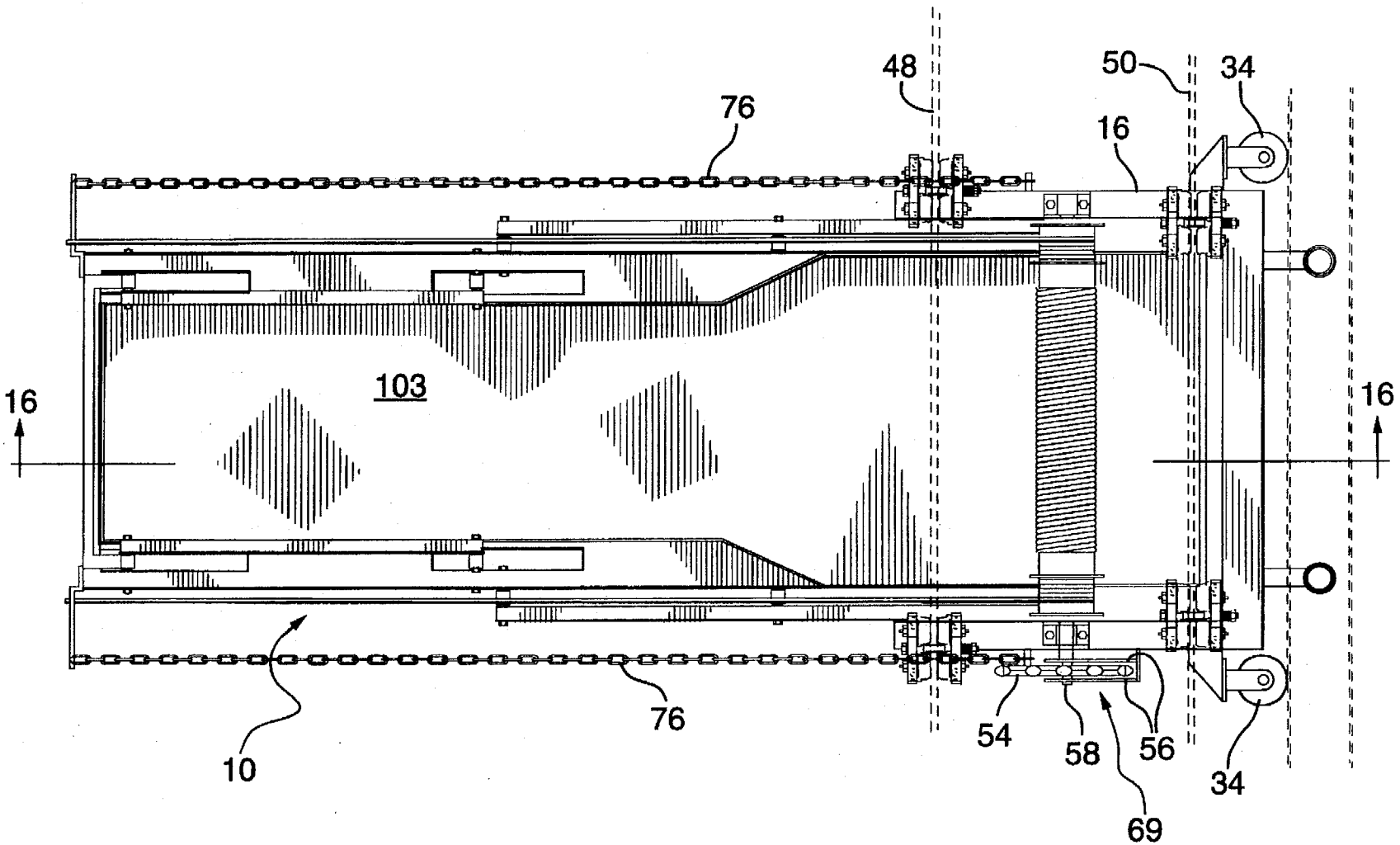
FIG. 3 is a top view of the collapsible catwalk in the open position shown in FIG. 1.

Referring first to FIGS. 1, 2 and 3, the catwalk 10 of the invention is shown in its open, operative position. The catwalk 10 has a supporting frame 12 which comprises a base 14, a top section 16, and a pair of vertical, spaced apart trusses 18, 20 interconnecting the base 14 and the top section 16. Each vertical truss 18, 20 comprises posts 22, 24 diverging from the base 14 to the top section 16 with rear post 24 being substantially vertical and front post 22 inclined at an acute angle from the vertical to form an enlarged top section 16. Cross-linking beams 26 and 28 connect each pair of vertical posts 22, 24 together for structural rigidity. Diagonal struts 30 which extend from below the centre of upper beam 31 of the top section 16 are attached to cross-linking beams 28 to impart lateral stability to the frame 12 (FIGS. 1 and 2).

The base 14 may have one or a plurality of guide wheels depending rearwardly from it. In the preferred embodiment as shown in FIGS. 1, 2 and 3, two spaced apart guide wheels 34 depend laterally outwardly from the base 14 into rolling contact with flange 23 of I-beam 32 for lateral guided movement of the base 14. Guide wheels 34 are journalled for rotation within brackets 36 which depend laterally outwardly from each side of base 14.

It may be desired in certain installations to elevate horizontal beam 32 to provide additional headroom, in which case brackets 36 and guide wheels 34 journalled therein would be mounted at a higher level on posts 24.

Figure 5:
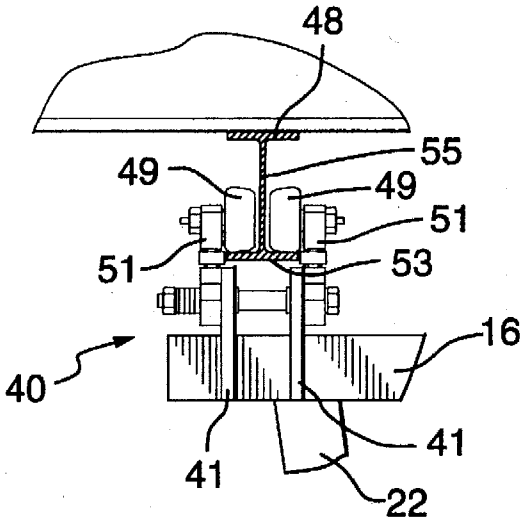
FIG. 5 is an enlarged fragmentary side view, partly in section, of a pair of upper guide wheels on an I-beam.

The top section 16 of the frame 12 has two sets of guide wheel trolleys 40, 42 and 44, 46 cooperating with spaced apart front and rear I-beams 48 and 50 respectively for vertical support of the supporting frame 12 and for lateral guided travel of frame 12 on I-beams 48 and 50. Guide wheel trolleys 40, 42 are supported on the front 1-beam 48, shown most clearly by trolley 40 in FIG. 5, which is representative of the trolleys. Trolley 40 comprises two pairs of laterally spaced opposed rollers or wheels 49 journalled in trolley housing 51 secured to brackets 41 connected to top section 16. Wheels 49 engage flange 53 of I-beam 48 to straddle I-beam web 55. Guide wheel trolleys 44, 46 are located on the rear I-beam 50 and support the rear of top section 16 on flange 57 of I beam 50

Figure 13:
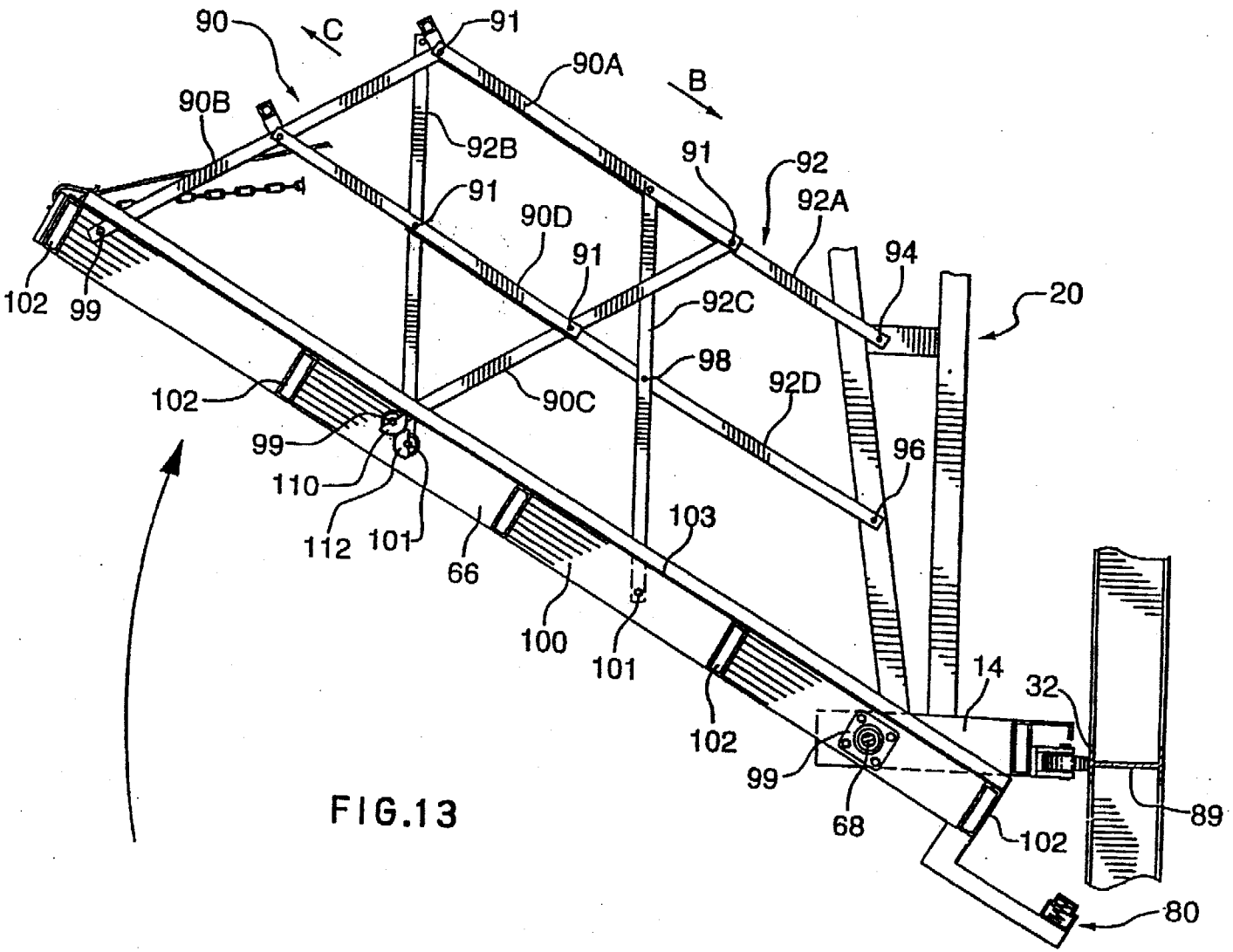
FIG. 13 is an enlarged fragmentary side elevational view of the collapsing of the guide rails attached to the platform of the collapsible catwalk.

Catwalk platform 66 is pivotally supported on base 14 by rod 68 extending through Bushings 99 attached to side members 100. Equi-spaced, transverse members 102 welded or bolted onto side members 100 define the rigid rectangular frame 66 on which deck 103 is mounted, as shown in FIG. 13.

With reference now to FIGS. 1–3, 5, 8 land 9, a pair of parallel, spaced apart hoist cables 64 connected to brackets 65 at the distal end of platform frame 66 are wound onto winch 70 which is journalled for rotation in top section 16, as shown most dearly in FIG. 1. Winch 70 is rotated to pivot platform 66 upwardly about pivot rod 68 by a chain drive 69 comprising chain 52 which engages peripheral teeth of pulley 54. Pulley 54 is rotatably mounted in the top section 16 of flame 12 by axle 58 journalled in brackets 56. Axle 58 carries pulley 59 which is interconnected with pulley 60 by V belt 62. The movement of chain 52 in a clockwise or counterclockwise direction as viewed in FIG. 1 rotates pulley 54 and pulley 59 to drive pulley 60 by belt 62. Hoist cables 64 wound on winch 70 having shaft 72 thus clan be retracted to raise platform frame 66 or extended to lower platform frame 66. Coil spring 74 concentric with shaft 72 counterbalances the weight of platform 66 when in its extended position.

Figure 4:
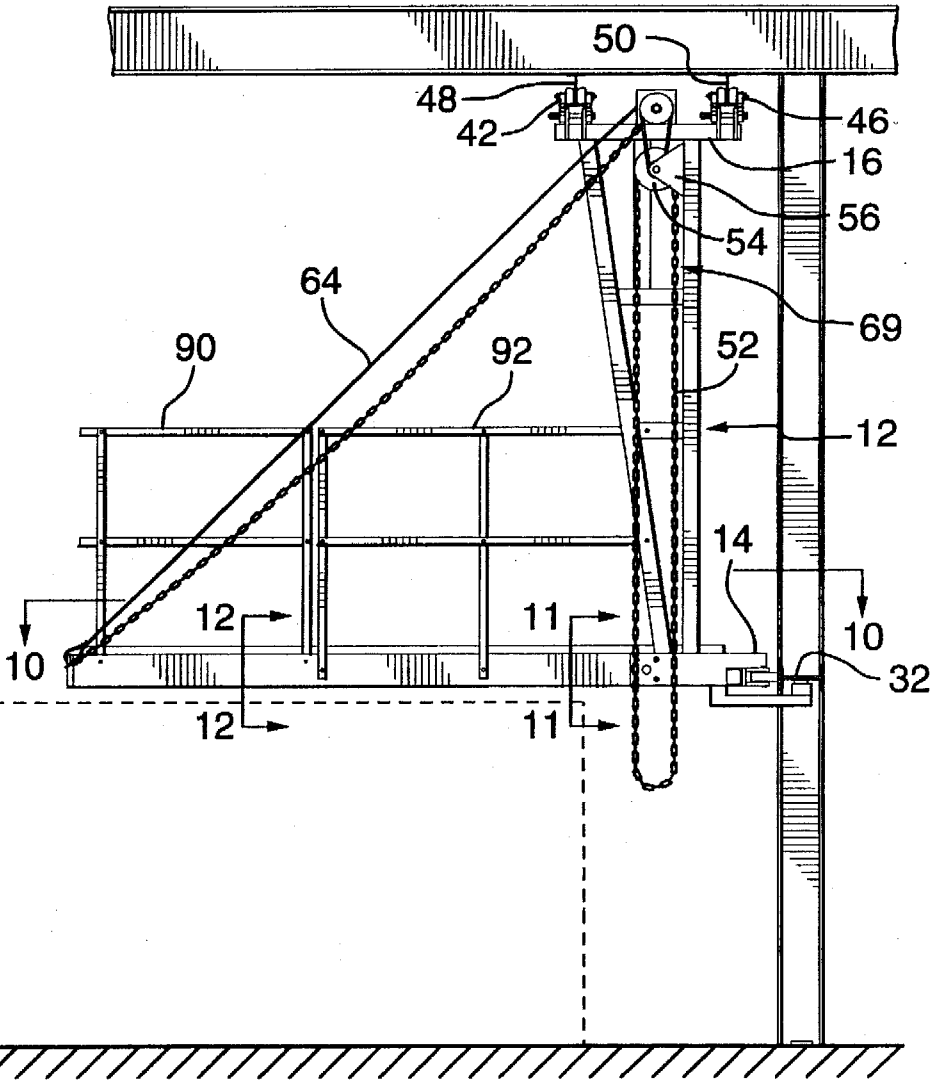
FIG. 4 is a side elevational view of the collapsible catwalk in an open position over a workpiece.

Safety chains 76 dispose on either side of platform 66 and connected at their lower ends to brackets 65 and at their upper ends to top section 16 limits the downward, pivotal travel of platform 66 to a generally horizontal position about pivot rod 68. The center of gravity of support frame 12 and platform frame 66, when extended as viewed in FIG. 4, is to the left of frame 12 i.e. to the front of the vertical plane of the support frame 12 causing the apparatus to continuously bias wheels 34 rearwardly to the right against the flange 23 of I-beam 32.

Figure 6:
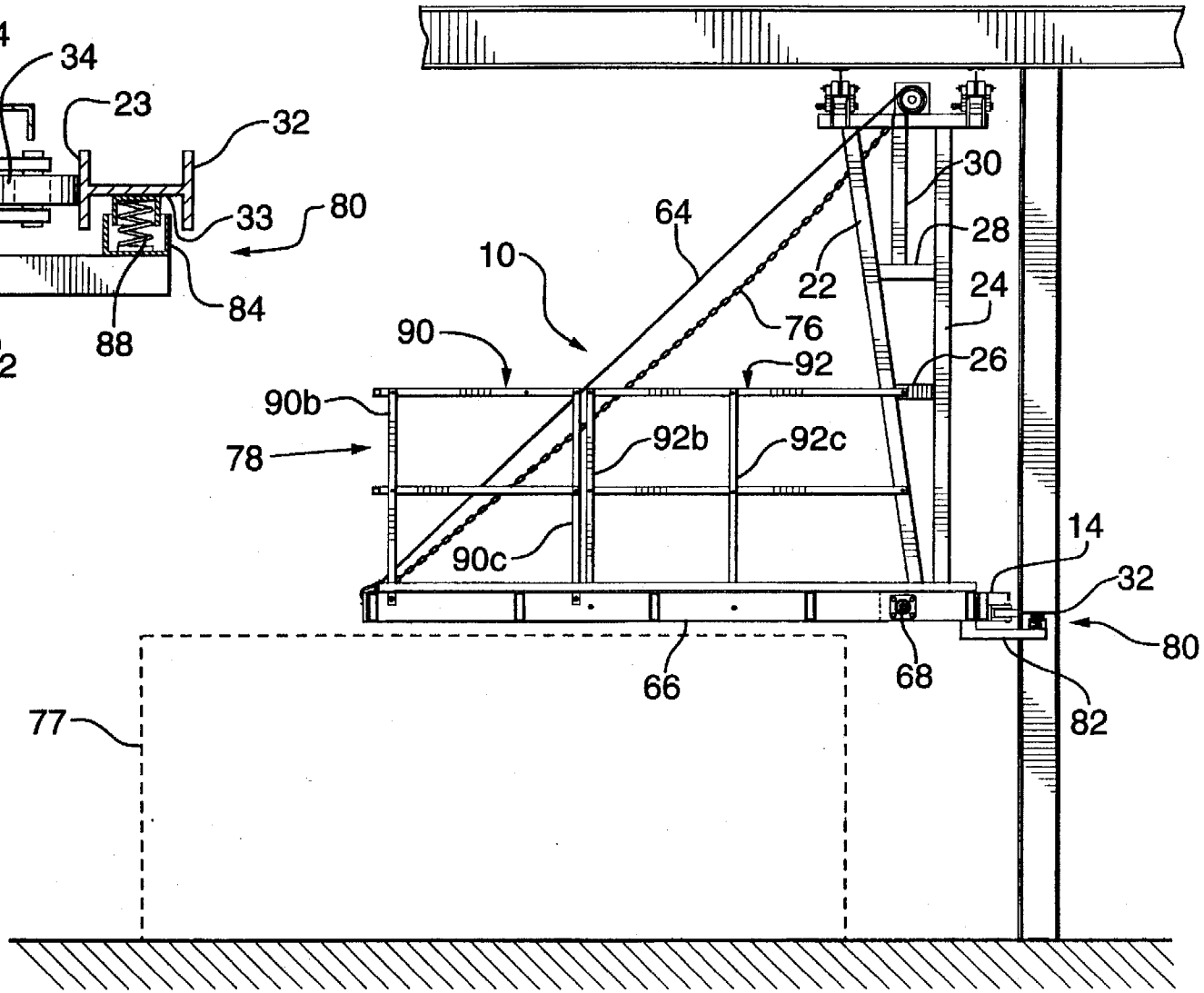
FIG. 6 is a longitudinal section of the collapsible catwalk in the open position along the line 6—6 of FIG. 3.

FIG. 6 shows the catwalk 10 in the open position above workpiece 77 shown in ghost lines. Collapsible safety rafts 78 are affixed to platform 66, to be described.

Figure 7:
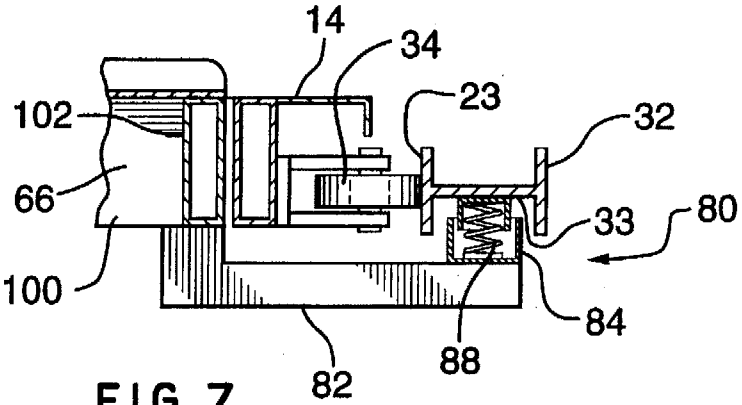
FIG. 7 is an enlarged fragmentary cross-sectional view of the brake of the collapsible catwalk shown in FIG. 6.
Figure 11:
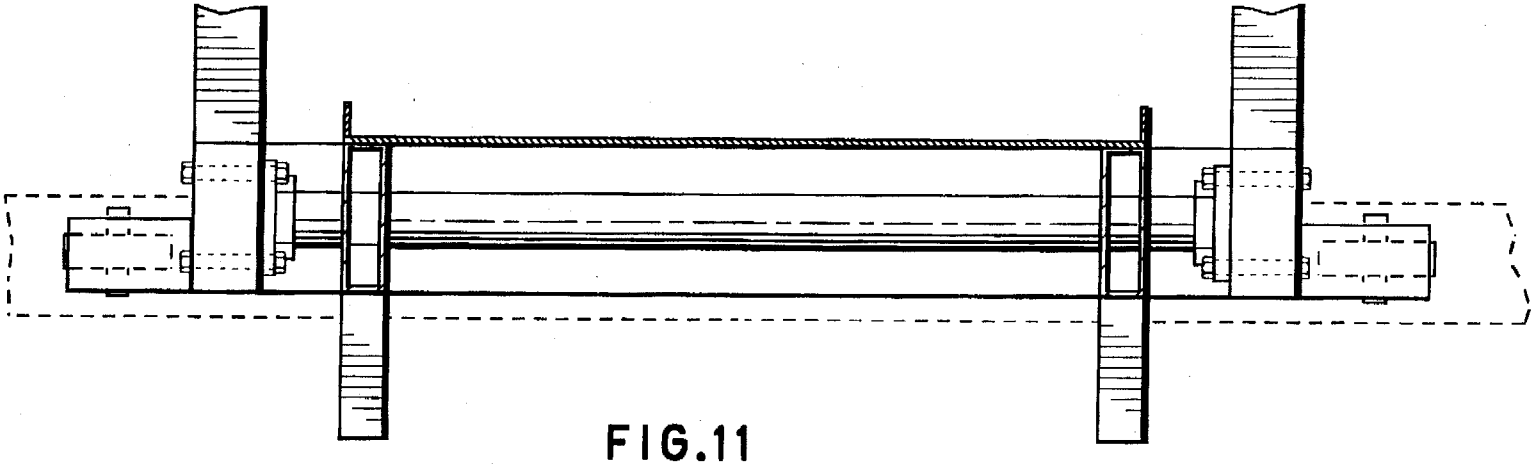
FIG. 11 is a transverse sectional view taken along line 11—11 of FIG. 4.
Figure 12:
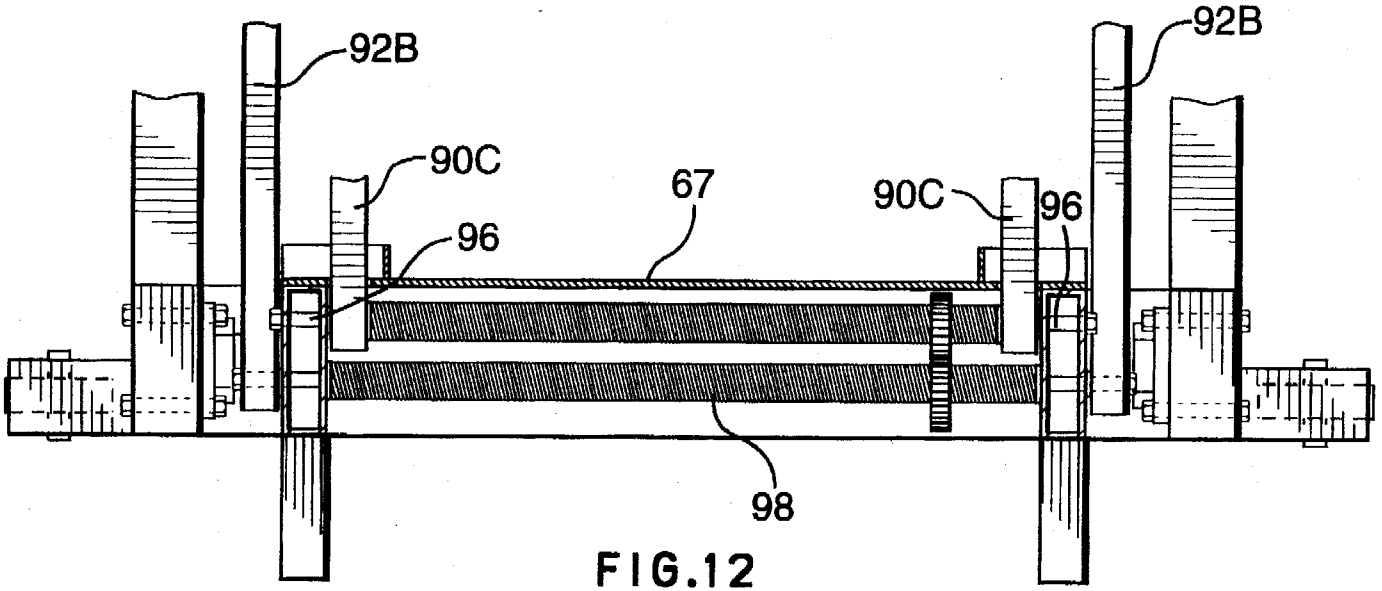
FIG. 12 is a transverse sectional view taken along line 12—12 of FIG. 4.

With reference now to FIGS. 6, 7, and 13 or the drawings, a pair of spaced apart safety brakes 80 are provided on the rearmost portions of base 14. Brakes 80 comprise a rearwardly extending bracket 82 secured to the underside of each of side rails 100 behind axle 68 (FIG. 11). A cylinder 84 attached to each bracket 82 contains piston pad 86 biased upwardly by compression spring 88, as viewed in FIG. 7, to abut web 33 of I-beam 32 when platform frame 66 is in its horizontal operative position.

If beam 32 is elevated, as has been discussed, braking can be provided by abutment of a detent, not shown, against the upper flange of I-beam 50 when platform 66 is in its extended position and frame 12 is pivoted in a counterclockwise direction, as viewed in FIG. 1.

With reference now to FIGS. 1–3 and 10–13, safety rails 78 extend about the periphery of platform frame 66. A first section 90 comprises upper rails **90*a* and intermediate rails 90*d* on each side supported by vertical standards 90*b* and 90*c*, as viewed in FIGS. 1 and 13, pivotally connected at their intersections by bolts or rivets 91. Posts 90*b* and 90*c* pass through slots 93, 95 formed in subfloor 97 and are pivotally connected to the inside of side members 100 by bolts 99**.

A second section 92 comprises upper rails **92*a* and intermediate rails 92*d* on each side pivotally mounted on each of trusses 18, 20 by bolts 94, 96 at the inboard ends and pivotally mounted on standards 92*b* at their inner ends and on standard 92*c* at a central support position by bolts or rivets 98. Standards 92*b*, 92*c* are pivotally mounted on the outside of side members 100 by bolts 101**.

Figure 10:
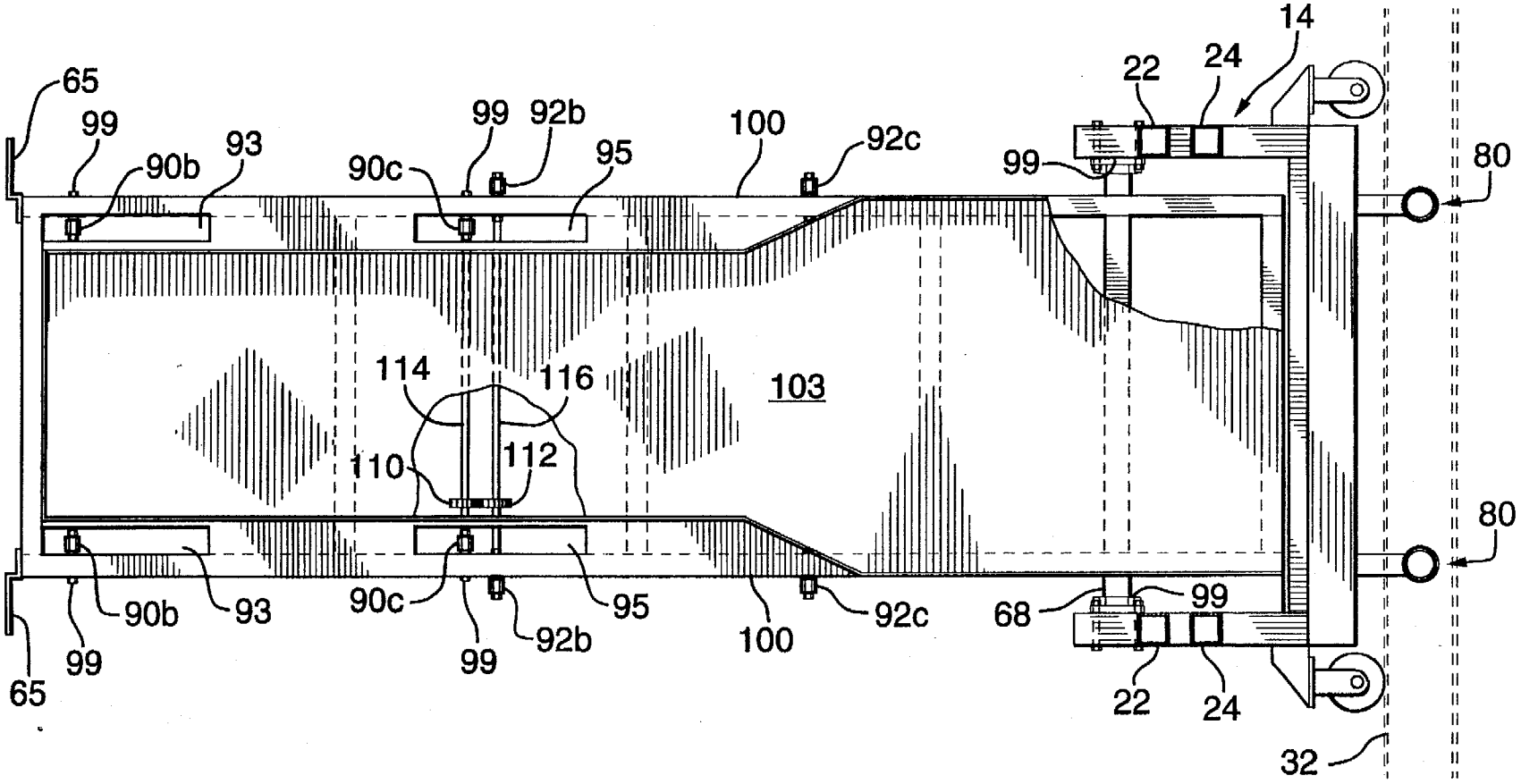
FIG. 10 is a fragmentary top plan view taken along line 10—10 of FIG. 4.

With reference to FIGS. 10 and 13, semi-circular intermeshing gears 110, 112, mounted on shafts 114, 116 respectively, are journalled for rotation in side rails 100. Shafts 114, 116 are in turn rigidly secured to extensions of standards **90*c*, 92*b*** respectively.

Figure 8:
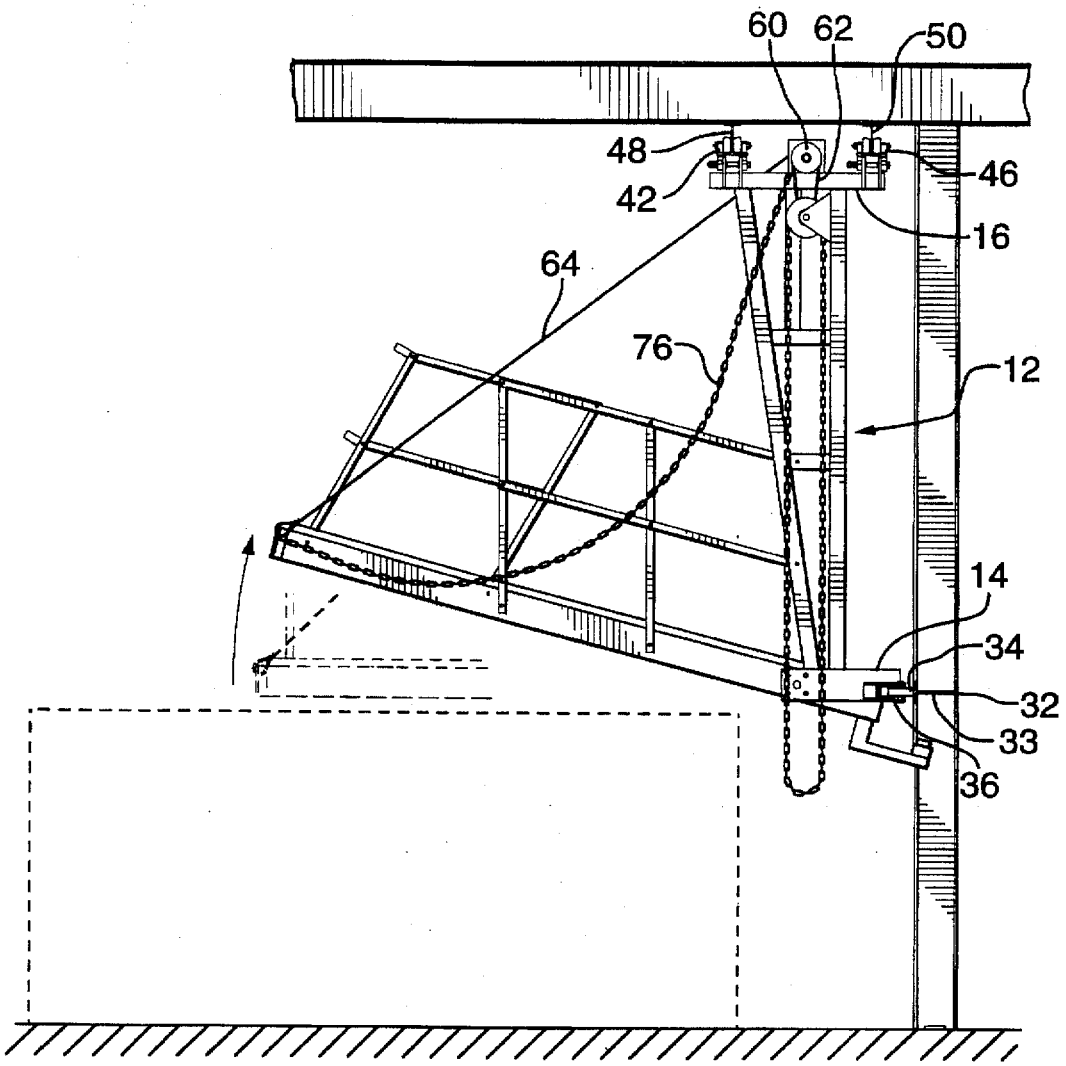
FIG. 8 is a side elevational view showing the collapsible catwalk being pivoted upwardly from its open, extended position.
Figure 9:
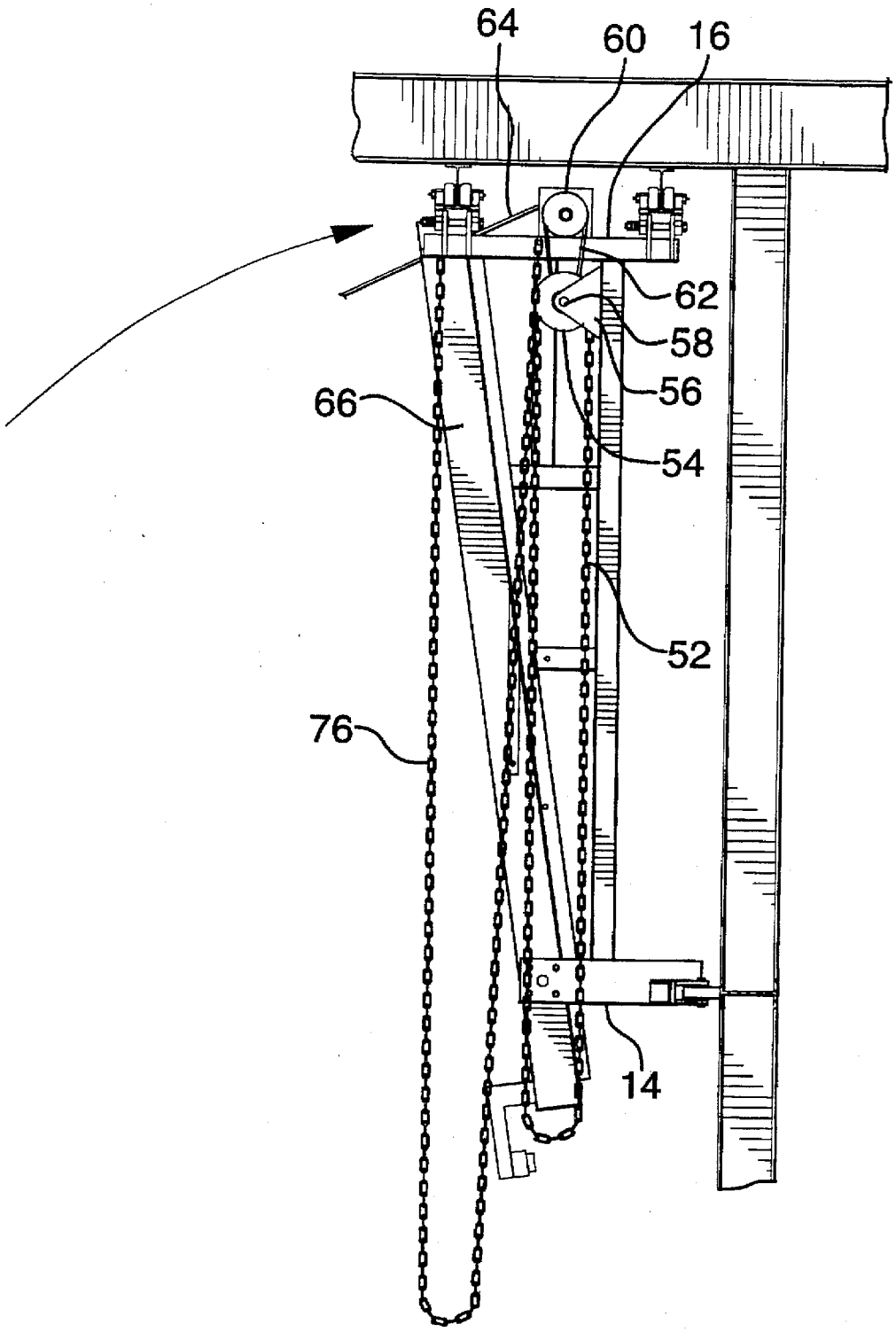
FIG. 9 is a side elevational view of the collapsible catwalk in an upright closed position.

In operation, the catwalk 10 can be moved laterally when in its collapsed or partially collapsed configurations, as viewed in FIGS. 8, 9 and 13. Overhead trolleys 40, 42 and 44, 46 suspended from 1-beams 48 and 50 allow facile lateral movement of the apparatus, the spaced apart rearwardly extending guide wheels 34 in rolling contact with I-beam 32 maintaining the apparatus in a vertical position. The catwalk platform frame 66 is lowered by actuation of chain drive 69 to extend hoist cables 64 from winch 70 and pivot frame 66 about the axis of rod 68 to the horizontal configuration shown in FIGS. 1 and 6. Safety rails 78 are extended, section 92 by pivoting of rails **92*a* and 92*d* about pivot connections 94, 96 respectively, and outer section 90 by engagement of meshing gears 110, 112. Brake 80 is actuated upon abutment of pads 86 against flange 23 of I-beam 32 when platform 66** is in the horizontal position, to lock the apparatus from lateral movements.

The platform 66 is easily retracted to the collapsed position or retracted sufficiently to release brake 80 by actuation of chain drive 69 to retract cables 64 into winch 70.

Optionally, the trolleys and the winch can be motorized, as is well known in the art, to permit remote-control operation for lateral movement and extension and retraction of the catwalk.

It will be understood, of course, that modifications can be made in the embodiments of the invention described herein without departing from the scope and purview of the invention as described by the appended claims.

I claim:

1. A collapsible catwalk comprising, in combination:

a support frame having a base and a top section; trolley means mounted on the frame top section adapted to suspend the support frame for lateral linear travel on at least one horizontal support rail, at least one guide wheel extending rearwardly from the support frame for maintaining the support frame vertical and for facilitating and guiding the support frame during lateral linear travel, a platform pivotally mounted on the support frame at the base thereof for pivotal movement from a substantially vertical retracted position to a substantially horizontal extended forward position, collapsible safety rails surrounding the platform pivotally mounted on the platform for collapse upon retraction of the platform and for erection upon extension of the platform and brake means extending rearwardly from the platform for stopping the lateral movement of the catwalk when the platform is extended to its horizontal position and wherein said brake means are disengaged when the platform is in its vertical retracted position.

2. A collapsible catwalk as claimed in claim 1, in which said support frame comprises a pair of laterally equi-spaced vertical trusses having a narrow base and a relatively wide top section, and said trolley means comprise two sets of guide wheel trolleys mounted on the wide top section, one set mounted behind the other set and parallel thereto for suspension of the support frame on a pair of parallel support rails.

3. A collapsible catwalk as claimed in claim 2, comprising a pair of spaced apart guide wheels extending rearwardly from each side of the base for rolling engagement with a horizontal I-beam.

4. A collapsible catwalk as claimed in claim 3, in which said pair of parallel support rails comprise a pair of horizontal I-beams each having a lower flange, and in which each set of the guide wheel trolleys has two pairs of opposed rollers journalled in a trolley housing for engaging the I-beam lower flange for travel thereon.

5. A collapsible catwalk as claimed in claim 4, in which the catwalk support frame and platform have a centre of gravity offset fowardly from the vertical plane of the support frame whereby the frame base is continuously biased by gravity rearwardly such that the pair of spaced apart guide wheels are in continuous rolling engagement with the horizontal I-Beam.

6. A collapsible catwalk as claimed in claim 3, wherein said guide wheels are journalled for rotation within brackets which depend laterally outwardly from each side of the base.

7. A collapsible catwalk as claimed in claim 1, wherein at least two shafts journalled for rotation in said platform are fixed to said safety rails, said shafts having at least one pair of intermeshing gears which cooperate to collapse said safety rails upon retraction of the platform and to erect said safety rails upon extension of said platform.

8. A collapsible catwalk as claimed in claim 1, wherein said brake means extends rearwardly from the said platform and engages a horizontal beam for stopping the lateral movement of the catwalk when the platform is extended to its horizontal position.

9. A collapsible catwalk as claimed in claim 1, additionally comprising a winch rotably mounted on said support frame having at least one hoist cable fixedly connected to said winch and fixedly connected at the other end to said platform whereby rotation of said winch rotates and winds said hoist cable about said winch for retraction or extension of said platform.

10. A collapsible catwalk as claimed in claim 9, wherein said winch comprises a shaft and a coil spring concentric about said shaft whereby said spring counterbalances the weight of said platform.

* * * * *